US006744366B2

(12) United States Patent
How

(10) Patent No.: US 6,744,366 B2
(45) Date of Patent: Jun. 1, 2004

(54) METHOD AND APPARATUS OF OBTAINING SECURITY TAG OPERATION USING LOCAL MAGNETIC MARKER

(76) Inventor: Hoton How, 262 Clifton St., Belmont, MA (US) 02478

( * ) Notice: Subject to any disclaimer, the term of this patent is extended or adjusted under 35 U.S.C. 154(b) by 116 days.

(21) Appl. No.: 10/115,493

(22) Filed: Apr. 4, 2002

(65) Prior Publication Data

US 2003/0189489 A1 Oct. 9, 2003

(51) Int. Cl.[7] ..... G08B 13/14

(52) U.S. Cl. ..... 340/571; 340/551; 340/572.1; 340/539.1

(58) Field of Search ..... 340/571, 563.1, 340/572.1, 572.8, 531, 539.1, 686.1, 573.1, 573.4, 551

(56) References Cited

U.S. PATENT DOCUMENTS 4,417,235 A * 11/1983 Del Grande ..... 340/531
4,510,490 A * 4/1985 Anderson, III et al. .. 340/572.1
4,520,349 A * 5/1985 Varano ..... 340/531
4,698,621 A * 10/1987 Masot ..... 340/639
4,851,815 A * 7/1989 Enkelmann ..... 340/571
5,233,544 A * 8/1993 Kobayashi ..... 702/141
5,552,773 A * 9/1996 Kuhnert ..... 340/573.1
5,565,845 A * 10/1996 Hara ..... 340/568.6
5,602,532 A * 2/1997 Ryan ..... 340/639
5,917,405 A * 6/1999 Joao ..... 340/426.17
6,486,777 B2 * 11/2002 Clark ..... 340/539.1
6,577,238 B1 * 6/2003 Whitesmith et al. ..... 340/572.1

* cited by examiner

*Primary Examiner*—Benjamin C. Lee

(57) ABSTRACT

Disclosed is a method and an apparatus implying nearly 100% security with a tag system showing low cost and compact volume. Like a conventional tag, the disclosed tag system will respond properly to an interrogation signal. In addition, the disclosed tag system is able to monitor the environment local to a merchandise. Whenever the merchandise package is opened and/or impaired, alarm will be generated on the spot. It is almost impossible to disarm the tag system, unless a password is attained. The disclosed tag system shows a high sensitivity, and it does not need an electronic searching machine, or an interrogation gate, to operate. When combined with an electromagnetic transmitter, a smart tag system results, allowing merchandise to be traced on the computer screen, capable of performing discriminative tasks according to the imposed regulation rules on the merchandise IDs.

21 Claims, 3 Drawing Sheets

Figure 1:
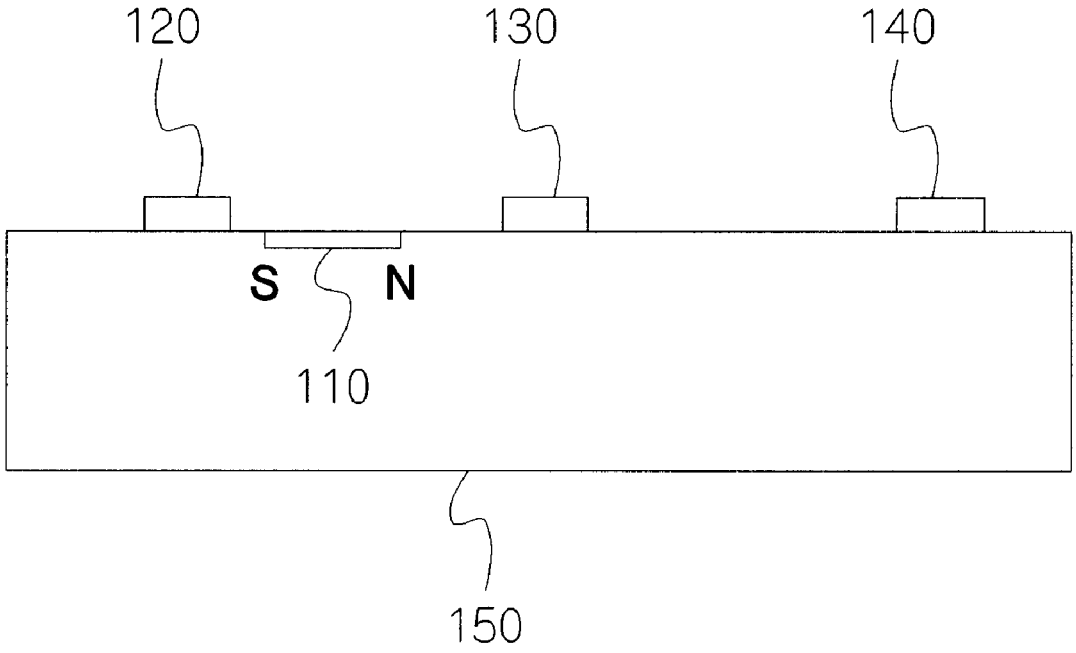

METHOD AND APPARATUS OF OBTAINING SECURITY TAG OPERATION USING LOCAL MAGNETIC MARKER

FEDERALLY SPONSORED RESEARCH (Not Applicable)

SEQUENCE LISTING OR PROGRAM (Not Applicable)

BACKGROUND

1. Field of Invention

This invention is directed to a method and an apparatus to obtain security tag operation using a local magnetic marker. In other words, a security tag is operational being able to respond to an interrogation signal clarifying the unpaid condition, as well as to monitor the environmental change local to a merchandise package, thereby reporting other offensive conditions such as package intrusion, distortion, violation, damaging, etc.

2. Prior Art

Today security tags are commonly used in retail stores and in supermarkets protecting merchandise against unauthorized removal. The conventional method involves the detection of the magnetization state of a magnetic tag attached to a commercial item seeking for protection. If the item has been properly checked out via a store clerk, the tag will be demagnetized at the cashier desk so as not to arouse an alarm installed near the doorway of the exit. However, if the item is carried out sneakingly without passing through the required checkout procedure, the alarm will be activated, identifying an unpaid item at the doorway.

The most serious drawback of the prior art is that there is no way to clarify an unpaid item at the doorway whose equipped security tag has already been removed or deactivated before exiting. To facilitate the checkout procedure at the cashier desk, the tag is normally attached to the merchandise at a prominent position unconcealed from the outside so that demagnetization of the tag can be conveniently carried out upon paying off. This offers opportunities for the burglar, and the burglar can readily peel off the tag with hands, or cut out the tag by using a razor blade, rendering the merchandise totally unprotected at the doorway exit.

To prevent the aforementioned situations to occur, the prior art dictates the tag to be wrapped around inside a thick plastic case or box which can not easily be opened or cut in a hurry. This increases the cost of the merchandise. The plastic box is transparent to human eyes and hence it will not impede the required checkout procedure at the cashier desk, but to add difficulty against unauthorized removal of the tag. However, even so, the burglar can still deactivate the tag by demagnetizing the tag using a permanent magnet, in as much as the same way that the store clerk is proceeding at the cashier desk during a normal checkout. By using a rare-earth metal permanent magnet, the magnet takes a volume less than 1 $cm^3$, and hence this covert action can hardly be noticed in the store. To an experienced burglar, the easiest way to steal a commercial item under tag protection is to place the item as a whole inside a briefcase or a purse whose interior has been installed in advance with a thin soft-magnetic metal sheet, such as iron, nickel, cobol, or their alloys. Stealing in this way occurs in just seconds, and the alarm system can never be aroused, since the interrogation signal has no way to penetrate across the soft-magnetic metal sheet to reach the tag, and so does the responding signal from the tag to reach the detector. This process is called magnetic screening in the literature.

Some other annoying behaviors of the customers are that they enjoy to open a well-packaged merchandise to look at its inside without an intention to buy, some for curiosity, some for fun, and some for the purpose of steeling its parts, such as the enclosed manual, software, and so forth. A merchandise with its original package damaged can hardly be sold at a regular price, resulting in loss of the retail store or the supermarket. Again, the conventional security-tag system contained in the art has no way to guard against these offensive situations, and indeed new method and apparatus are in need.

OBJECTS AND ADVANTAGES

Accordingly, it is an object of the invention to address one or more of the foregoing disadvantages or drawbacks of the prior art, and to provide such an improved method and apparatus to obtain security tag operation with added protection and performance coverage. That is, the disclosed method and apparatus lead to a tag system which can not only respond to an interrogation signal in as much as the same way that a conventional tag system does, but also it is able to guard against those offensive situations that a merchandise is liable to be damaged by a customer. It is almost impossible to remove or deactivate the tag system equipped with the merchandise without knowing the secret code, or password, which is required by the demagnetizing process. The tag will guard against the screening condition too, and hence the protection is nearly 100%. Most importantly, the disclosed security-tag system is convenient in use with high accuracy, as compact in size as the conventional system, but costs less. The detection scheme is simpler, and hence false alarms are less frequent, if not totally inhibited.

Other objects will be apparent to one of ordinary skill, in light of the following disclosure, including the claims.

SUMMARY

In one aspect, the invention provides a method which sets up a security tag system via establishing a local relatively fixed magnetic environment using a magnetic marker. Any disturbance to this local-field environment can be readily checked, with a purpose not only to prevent the tag system from unauthorized removal, but also to guard against those offensive situations leading to merchandise damage. The tag system will respond to an interrogation signal if not being properly checked out. To deactivate the system, a password is required, which can not be obtained by a burglar. A second tag can be simultaneously applied to the system to detect the null condition, indicating the tag has been concealed in a screening sheet. The tag system is thus 100% secure providing full protection over a commercial merchandise.

In another aspect, the invention provides an apparatus which requires, in addition to a local magnetic marker, several units to constitute on-site guard electronics. The marker is furnished by a permanent magnet which is located at a hidden site. Depending on the size of the merchandise and the scope of protection, the size of the marker varies. The guard electronics includes a sensor unit capable of distinguishing 3 levels of an exposed magnetic field with sufficient resolution, corresponding to a local field, an interrogation field, and a reset field. Once recognized the exposed magnetic field, the microprocessor unit starts to function, taking necessary actions in response, either to ring a buzzer, to arouse an alarm, or to reset the electronics. While the marker will dispense with the merchandise after sale, the on-site guard electronics will be retrieved back to be reused with a new merchandise, thereby keeping the cost of the tag system at a minimum. The on-site guard electronics is encapsulated in a small stainless steel case assuming a minimum volume, which is mechanically hard to prevent against being damaged on purpose.

DRAWINGS

Figures

For a more complete understanding of the nature and objectives of the present invention, reference is to be made to the following detailed description and accompanying drawings, which, though not to scale, illustrate the principles of the invention, and in which:

FIG. 1 shows one example of the preferred embodiment of the invention that on-site guard tags are used with a merchandise equipped with a local magnetic marker located at a hidden site. Although one guard tag is sufficient to guard against an unexperienced burglar, three guard tags are shown in this example to provide full security. While two guards measure their respective local fields in complementary for added security and reliability, the third guard tag is to detect the null condition that the tag system is being concealed in a screening sheet.

Figure 2:
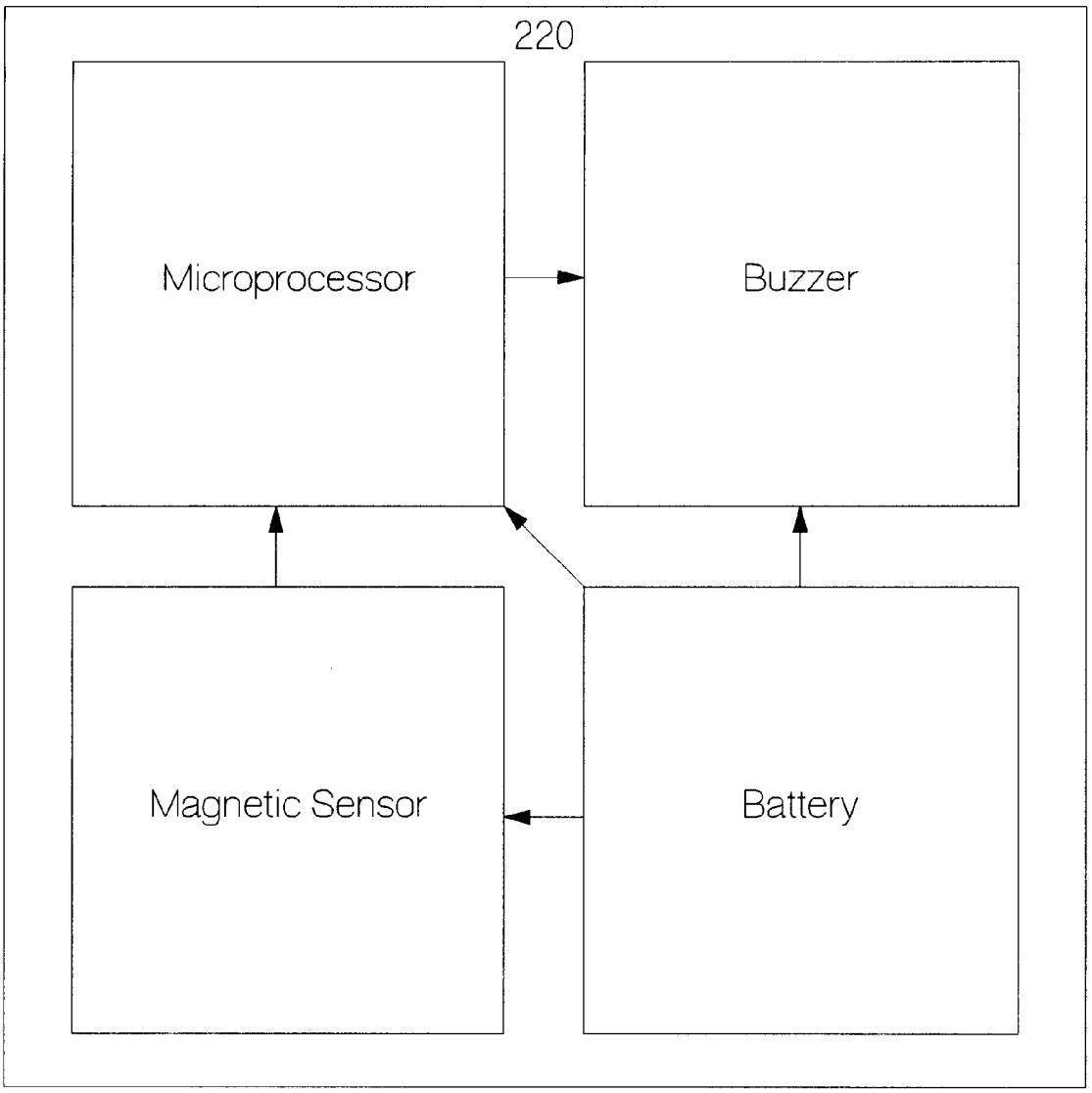

FIG. 2 shows the same example of FIG. 1 that four units are included with a guard tag whose mutual relationships are demonstrated in a block diagram. The four units are: magnetic sensor unit, which measures the local magnetic field, buzzer unit, which provides an alarm sound, microprocessor unit, which makes decision and initiates a control signal onto the buzzer unit, and power unit, which supplies power to the other three units.

Figure 3:
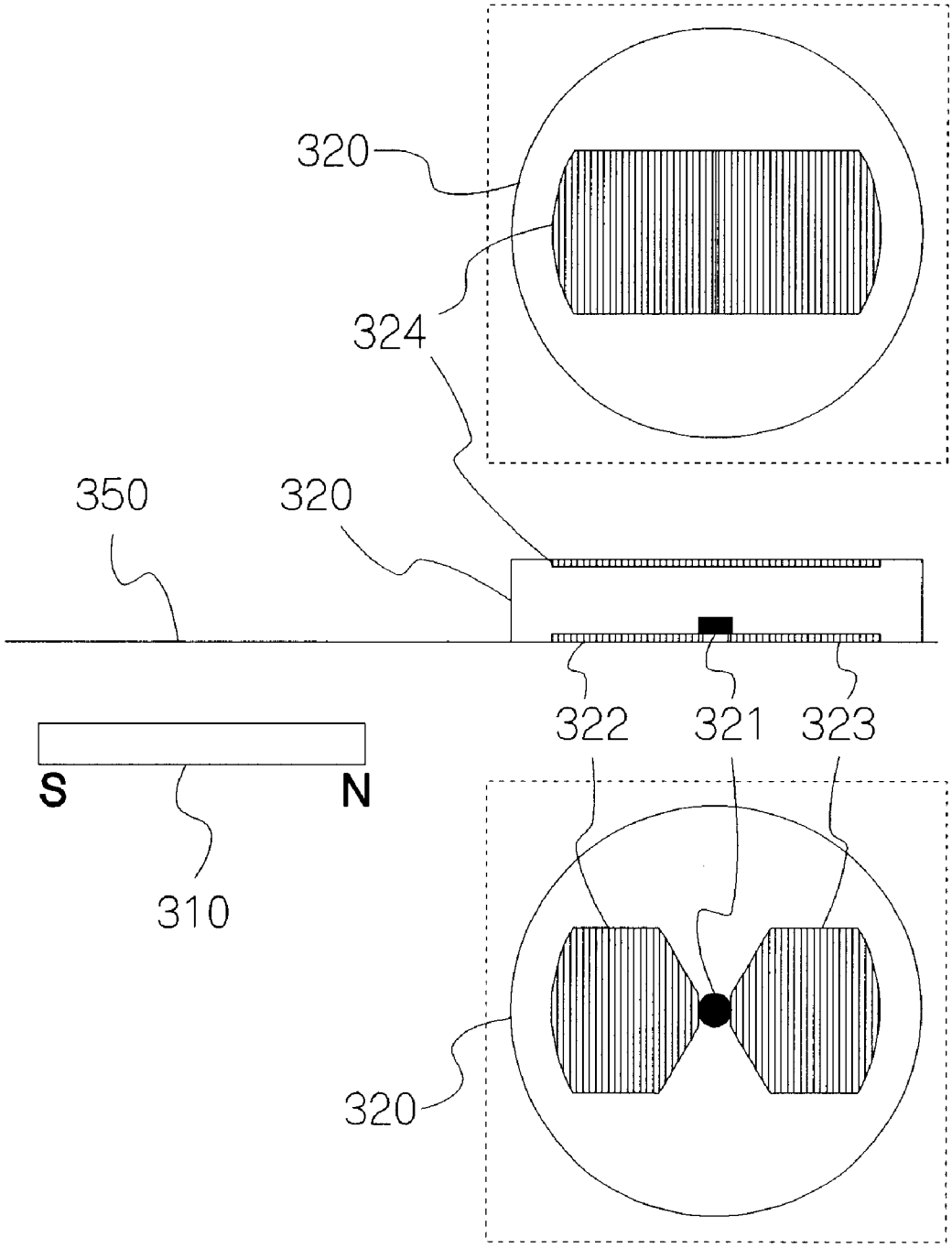

FIG. 3 shows the same example of FIG. 1 under enhanced security requirements. The setup of guard electronics includes a local magnetic-shielding plane and a pair of local yoke arms to isolate the system from external interference on one hand, and to condense the local magnetic field nearby to increase measurement sensitivity on the other hand. This enhanced setup can thus reduce considerably the false alarm rates.

REFERENCE NUMERALS

| | |
|---|---|
| 110 | Magnetic Marker |
| 120 | Guard Tag 1 |
| 130 | Guard Tag 2 |
| 140 | Guard Tag 3 |
| 150 | Merchandise Package |
| 220 | Guard Tag |
| 310 | Magnetic Marker |
| 320 | Guard Tag |
| 321 | Magnetic Probe |
| 322, 323 | Local Condenser Arm |
| 324 | Local Shielding Plane |
| 350 | Merchandise Package |

DETAILED DESCRIPTION

Preferred Embodiment:—FIG. 1 and FIG. 2

FIG. 1 shows one example of the preferred embodiment of the invention that Magnetic Marker 110 is installed with a merchandise whose package is outlined as 150, Merchandise Package. Magnetic Marker is essentially a permanent magnet whose north and south poles are noted in FIG. 1. In FIG. 1 local fields produced by Magnetic Marker 110 are characterized using 3 guard tags, Guard Tag 1, 120, Guard Tag 2, 130, and Guard Tag 3, 140. Magnetic Marker 110 and Guard Tag 1, 120, Guard Tag 2, 130, and Guard Tag 3, 140 are assumed to be located at considerably different positions so that their removal can hardly be proceeded simultaneously as in a rigid-body movement. That is, to remove them from their original positions on Merchandise Package 150, it is unavoidable to induce changes in their relative positions, and hence resulting in changes in their local fields. For example, Magnetic Marker 110 is glued to the paperboard box of Merchandise Package 150, and Guard Tag 1, 120, Guard Tag 2, 130, and Guard Tag 3, 140, are attached to the outer surface of the plastic sheet wrapping around the paperboard box of Merchandise Package 150. Thus, even by cutting the paperboard box and the plastic sheet together using, say, a razor blade, it can hardly avoid relative movements between Magnetic Marker 110 and Guard Tag 1, 120, Guard Tag 2, 130, and Guard Tag 3, 140, thereby causing the local fields to change. If these local field changes can be measured, the cutting action can thus be identified.

FIG. 2 shows the block diagram of Guard Tag 220. In FIG. 2 Magnetic Sensor Unit continuous measures the local magnetic field at the tag position and reports the measurement to Microprocessor Unit. The measured local field is compared with a value initially stored in the memory of Microprocessor Unit during the setup cycle, and if large discrepancy occurs, Microprocessor Unit initiates a command to Buzzer Unit to ring a buzz. The stored local field value may be gradually updated so as to accommodate changes, for example, due to aging of Magnetic Marker 110 shown in FIG. 1. The Battery Unit supplies power to the other three Units, Microprocessor, Magnetic Sensor, and Buzzer. Magnetic Sensor can be of many kinds, including Hall-effect probes, magnetoresistive transducers, fluxgate magnetometer, and so forth. Since measurements involve magnetic fields of magnitudes larger than the earth field, Hall-effect probes suffice, which constitutes the simplest instrument on magnetic-field measurements. Buzzer Unit includes a piezoelectric resonator. Circuits of Hall-effect probes and a piezoelectric resonator can all be fabricated using semiconductor compatible technologies, and hence they can be integrated with the circuit of Microprocessor Unit shown in FIG. 2. Miniaturized battery, such as a lithium battery, can be used for Battery Unit, and hence the size of Guard Tag 220 shown in FIG. 2 is minimum, to be comparable to the size of a penny, or smaller.

In FIG. 1 Magnetic Marker 110 takes various forms, depending on the size of the merchandise and the scope of protection. Normally, a magnetic marker assumes a tag geometry to be made of magnetic metal alloys, for example, alnico. A magnetic marker thus made is very inexpensive, which costs about a few cents, and hence it can be dispensed or disposed with the merchandise after sale. On the contrary a guard tag is rather expensive, which costs about a few dollars or more, and hence it shall be retrieved back after the sale is completed. A guard tag can be reused after sale to be installed with another merchandise, and hence it needs to be applied at a prominent position to facilitate its removal and subsequent installation.

Instead, in FIG. 1 Magnetic Marker 110 is preferred to be located at an unseen position, for example, inside the paperboard box of Merchandise Package 150. This makes cutting or removing Magnetic Marker 110, for example, very much uncertain, and hence the chance to generate measurable changes in local fields at the guard-tag positions is thus much increased. Also, Magnetic Marker 110 and Guard Tag 1, 120, Guard Tag 2, 130, and Guard Tag 3, 140, are preferred to be located near the openings of the paperboard box of Merchandise Package 150. As such, any attempt to open the paperboard box to steal parts from the merchandise can be readily identified, for example.

For a merchandise of a large size, or for a merchandise seeking for enhanced protection, multiple guard tags are needed, monitoring the local fields at a plurality of positions surrounding the merchandise package, protecting against the package to be opened or cut near these positions through a vicious mind. For example, in FIG. 1 Guard Tag 1, 120, and Guard Tag 2, 130, jointly monitor the top surface of Merchandise Package 150 so that local fields generated from Magnetic Marker 110 are measured simultaneously at these two guard tag positions. If Merchandise Package 150 is disturbed causing Magnetic Marker 110 to shift toward, say, Guard Tag 120, but to drift away from Guard Tag 130, local-field changes at these two guard-tag positions complement each other, to increase at the position of Guard Tag 120, but to decrease at the position of Guard Tag 130. Due to this complementary nature in field changes the sensitivity in measurement is increased, resulting in enhanced power in protection. For a merchandise of a large size, A magnetic marker may take a considerable volume assuming a large magnetization so as to generate measurable local fields at various guard-tag positions. Otherwise, a plurality of magnetic markers are needed, allocated at each individual guard-tag position responsible for generating its own local field.

In FIG. 1 Guard Tag 140 measures essentially the earth field, since Magnetic Marker 110 locates far away from Guard Tag 140. The purpose of Guard Tag 140 is not to monitor the surface condition of Merchandise Package 150, as Guard Tag 120 and Guard Tag 130 do. Rather, it watches against the null condition if earth field is being quenched out. For example, an experienced burglar knows that by concealing a conventional magnetic tag inside a magnetic screening sheet all magnetic signals, including the interrogation signal, will be effectively blocked out, thereby disabling the tag device from responding. However, by screening the magnetic field near Guard Tag 140, the earth field is blocked out too, causing the local field near Guard Tag 140 to change. This turns on Buzzer Unit of FIG. 2 giving rise to a buzzing sound signaling the burglar condition.

Three levels of magnetic fields are recognized by a guard tag, and they are the local field generated by a magnetic marker, an interrogation signal, and a signal requesting for resetting. Since the earth field is approximately 0.5 Oe, the local field from a magnetic marker is about an order of magnitude higher, to be around 5 Oe, which can be easily obtained by using a tag magnet deployed nearby, as shown in FIG. 1. An interrogation signal needs to be substantially higher than the local field, to be approximately near 10 Oe. This low-magnitude interrogation-field signal can be conveniently obtained by using either a Helmholtz coil or a rare-earth metal permanent magnet placed near the exit doorway. Thus, when a local field is measured by a guard tag with magnitude changing to the interrogation-field level, a buzzing sound is generated, indicating the burglar condition. By using a Hall-probe, for example, measurement on a DC interrogation signal can be extremely accurate, rendering high reliability in responding. As such, the false alarm rate can be much suppressed, if not totally eliminated.

Alternatively, an rf interrogation signal can be equally used, so long as its waveform shape or code is stored in the memory of Microprocessor Unit of FIG. 2. Upon receiving an interrogation signal Microprocessor Unit of FIG. 2 compares the measured value with the stored one, and if they coincide in waveform shape or code, an alarm buzz is generated. Since an active detection scheme is adopted for the presently disclosed tag system, the magnitude of the interrogation field needs not to be large, so long as it is well above the background noise level. This allows for decent tag-system operation: the interrogation signal can now be generated via hidden Helmholtz coils berried inside the wall near the doorway exit unseen by a customer. This is contrasted to the situation that a conventional tag system is operating, which adopts a passive detection scheme requiring the interrogation signal to have a substantial magnitude. Despite of the customer's feeling, the conventional system forces the customer to enter a restrictive gate to allow his or her body together with personal belongings to be searched by electronic signals. A protruding electronic searching gate can not only spoil the aesthetic view of a store, but also present potential threats to a customer, since nobody likes to be treated as a suspect. A hidden gate avoids altogether these kinds of problems. Also, an active detection scheme allows low-noise amplifiers to be incorporated in the measurement, resulting in much higher sensitivity and reliability when comparing to a passive detecting system.

At the cashier desk after the payment of the merchandise has been collected, guard tags installed with the merchandise need to be all reset. This allows guard tags to be removed from the package of the merchandise with their buzzers to be set in the mute or the quiet state. The mute state lasts for a short time period, for example, 1 minute, sufficient for each of the individual guard tags to be removed from the merchandise package. The rule of thumb is that the reset signal shall be difficult to obtain by a burglar in a hurry using his or her limited resources in a retail store or in a supermarket. Otherwise, the tag will be disabled, which can then be removed from the merchandise, allowing the merchandise to be carried away from the store without causing the alarm to buzz. This is exactly what has happened with a conventional tag system contained in the prior art.

Similar to an interrogation signal, a reset signal can be a DC signal or an rf signal, so long as it is difficult to obtain. For example, the reset signal may require a DC magnetic field of a magnitude as high as 10000 Oe, which can only be possibly obtained by using a giant magnet or using a huge power supply feeding into a Helmholtz coil with water cooling. Alternatively, an rf signal can be used. To ensure the reset signal to vary from one store to another, a password is required, which is translated by a software into a specific reset-signal waveform unique to a particular store. Thus, knowing one password from one store, or one reset-signal waveform, does not means the password, or waveform, will apply in another store, and hence the tag system becomes specific, providing 100% security for each of the stores. To operate, the reset signal waveform is first entered and stored in the memory of Microprocessor Unit of FIG. 2 during the setup cycle. Upon receiving a reset request, the measured signal waveform is compared with the stored one, and if they coincide in shape, a reset command is generated, setting Buzzer Unit of FIG. 2 in the mute state for a pre-specified length of time. This disarms the tag system, allowing the tag system to be removed from the merchandise.

To reuse a guard tag and to apply it onto a new merchandise package, again, a reset signal is needed, setting the buzzer unit in the mute state. Besides, other procedures will be called for by the firmware of Microprocessor Unit of FIG. 2. During this setup cycle the magnitude of the local field generated by Magnetic Marker 110 shown in FIG. 1 is stored onto the memory of Microprocessor Unit of FIG. 2. Also, interrogation waveform or code and reset-signal waveform or password are stored, if any. Battery status will be checked and the estimated time of performance will be reported. It is important to make sure the battery can last sufficiently long to cover the next protection period. Upon depletion of a battery, a guard tag can be malfunctioning, generating false alarms in a random manner. A depleting battery shall thus be avoided. It is desirable that Microprocessor Unit shown in FIG. 2 checks the status of the battery constantly, in a manner similar to that the local field at the guard-tag site is constantly monitored. Before the battery goes totally dead, a warning buzz is generated, reminding the store manager to charge or to replace the battery. To differ from an alarm buzz, which assumes a constant buzzing sound, a warning buzz manifests itself as an intermittent buzzing sound.

Guard Tag 220 shown in FIG. 2 shall be all contained in a, say, stainless-steel case occupying a minimum volume. The stainless-steel case conceals firmly with electrode terminals exposed at the outer surface, thereby facilitating the guard tag to be set up during the setup cycle. The stainless-steel case may be opened using a special tool with the buzzer unit being set to the mute state. This allows the battery to be removed from the guard tag for the purpose of recharge or replacement. Alternatively, the battery unit can locate outside the stainless-steel case so that battery can be readily replaced or recharged. However, to expose the battery outside the stainless-steel case means the battery can also be removed by a burglar. To protect against this situation a capacitor is needed to be placed inside the stainless-steel case storing a sufficient amount of charge which can be used in case of emergency. As such, whenever Microprocessor Unit of FIG. 2 detects a reversed current flow through this capacitor, burglar alarm arises, if it is not set at the mute state.

The stainless-steel case shall be mechanically strong enough to avoid it to be cut or damaged by a burglar. To protect a precious merchandise double protection seems necessary. To do this, Buzzer Unit of FIG. 2 is mechanically supported by a secondary structure inside the stainless-steel case which will survive after the first attack, for example, being squeezed by pliers. A capacitor is installed near the buzzer unit also under the protection of the secondary structure. When all of the other units fail, microprocessor, battery, etc., the capacitor feeds the buzzer to activate the burglar alarm. Note that this emergency capacitor discussed here under the case-crashing condition can be combined with the capacitor described in the last paragraph protecting against the power-interruption condition.

The buzzing sound generated by Buzzer Unit of FIG. 2 may not be loud enough to attract sufficient attention from a store clerk. External microphones, amplifiers, and speakers may thus used, allocated at regular spots inside the store, as well as at the doorway exit. When a buzzing sound is detected by a local microphone requesting for alarm, siren arises with an alarm lamp lighted and flashed on the spot, indicating something unlawful is currently undergoing.

Enhanced Operation:—FIG. 3

A conventional tag system responds to an interrogation signal in a complex manner and false alarms are not very uncommon to occur. The conventional tag system contained in the prior art incorporates rf interrogation usually at 10–20 KHz, and the interrogation signal drives the tag system encompassing the nonlinear saturation regime thereby generating harmonics at high orders, if the tag system has not been demagnetized at the cashier desk. By checking the magnitudes of the generated high-order harmonics, usually up to 10 orders, the alarm status is thus confirmed. The presently disclosed tag system imposes a much simpler detection scheme, and hence false alarm rate can be significantly reduced, if not totally suppressed. Furthermore, the conventional tag system employs a passive detection scheme, and the generated response signal from the tag system compares barely at the noise level. In contrast, the presently disclosed tag system adopts an active detection scheme allowing for low-noise amplifiers to be used along with signal generation and detection. The sensitivity of the presently proposed tag system is of course higher.

Magnetic field is a vector field, and any accurate measurement involving a vector field needs to include all of its three components. A conventional tag system measures only one component and hence significant error results. This leads to false alarms. The tag system of the example of the preferred embodiment of the present invention shown in FIG. 1 and FIG. 2 allows multiple magnetic probes to be involved, to be arranged in directions mutually perpendicular to each other. For example, if three mutually perpendicular Hall probes are included in the guard-tag systems shown in FIG. 1 and FIG. 2, the interrogation signal can be determined with negligible error. This reduces the false alarm rate to nearly zero, and hence the reliability of the presently disclosed tag system is much higher than the conventional tag system contained in the prior art.

The other source of error comes from local environment. For example, when two tags are brought together in close proximity, local fields change, since they overlap each other. In order to overcome problems of this kind an improved measurement circuit configuration is shown in FIG. 3. In FIG. 3 Magnetic Marker 310 is hidden inside Merchandise Package 350, and Guard Tag 320 locates as before on the outer surface of Merchandise Package 350. Local Shielding Plane 324 locates beneath the top cover of Guard Tag 320, and Local Condenser Arm pair, 322 and 323, are above the bottom cover of Guard Tag 320 with Magnetic Probe 321 sitting on the center. Two insets are shown in FIG. 3 with dashed borders, depicting the cross-sectional views of Local Shield Plane 324 and Local Condenser Arm pair 322 and 323 along with Magnetic Probe 321, respectively. Local Shielding Plane 324 and Local Condenser Arm pair 322 and 323 can be made of thin high-permeable magnetic soft metal layers, and Magnetic Probe 321 can be of any kind, Hall probe, magnetoresistive probe, fluxgate probe, etc.

Local Shielding Plane 324 prevents external magnetic fluxes from reaching the sensor region under Magnetic Probe 321. That is, when two guard-tag systems are brought together in close proximity, for example, their respective Local Shield Planes 324 will screen the magnetic field arising from the other guard-tag system from entering its own sensor region, thereby minimizing the interference effect. Local Condenser Arm pair 322 and 323 shown in FIG. 3 are tapered to form a gap at the center on top of which Magnetic Probe 321 resides. Local Condenser Arm pair 322 and 323 can not only focus magnetic flux nearby so as to enhance measurement sensitivity, but also average out local field in that region. That is, a minor shift of Guard Tag 320 relative to Magnetic Marker 310, due to vibration of merchandise, for example, will not change the averaged value of the local field near Magnetic Probe 321, and thus false alarm will not be generated, thereby smoothing the operation of the tag system disclosed in FIG. 3.

Photocell can be placed on top of Guard Tag 320 shown in FIG. 3 to substitute, at least partially, the use of a battery. Normally, lighting in a store or a supermarket is sufficient to support the operation of guard-tag systems shown in FIG. 1, FIG. 2, and FIG. 3. However, there are situations when the installed photocell is blocks by other merchandise, for example, so that the photocell is being disabled temporarily. To avoid mischief to happen a capacitor is needed, which stores charges to support the operation of the tag system for a short time. Meanwhile, a warning signal is sent out, for example, giving rise to an intermittent buzz sound, reminding the customer the tag shall be exposed under the light. If not corrected in time, alarm signal arises, consisting of a constant sound of buzzing, requesting for immediate attention.

Alternatively, a photodetector can be placed on top of Guard Tag 320 shown in FIG. 3 to detect the dark condition. The dark condition may arise accidentally that a guard tag is being blocked by another merchandise placed directly above. However, the dark condition can also come about when a burglar puts the merchandise inside his or her pocket, or in a purse, or in a briefcase, and so forth. When the dark condition occurs, a warning buzz will be generated first, followed by an alarm buzz if the dark condition insists. Thus, a photodetector provides additional protection over the merchandise already being secured by the tag system.

For an expensive merchandise there is no way to afford its loss if burglary occurs. If so, an electromagnetic (EM) transmitter needs to be installed with Guard Tag 320 shown in FIG. 3. That is, an EM transmitter is attached on top of Guard Tag 320 capable of emitting EM signals of predetermined waveforms or codes at a preselected frequency band. Furthermore, every guard tag has its own ID so that all of the merchandise or goods in a store or in a warehouse can be categorized and managed by a computer. Receivers are located everywhere inside the store or the warehouse so that the operation of the EM security system is in total analogy with the cellular phone system. That is, every cellular phone has its own ID, or telephone number, and every phone can be traced or touted by allocating or searching the network of receiver stations forming a cellular structure. Thus, via the network of EM receivers a guard tag equipped with an EM transmitter can be traced and located by the computer, and this can indeed help managing the goods or merchandise in the store or in the warehouse. For example, after a customer have described to the store clerk what he or she wants, the store clerk can locate the merchandise on the computer screen, if still available, and inform the customer where to find it. Meanwhile, manual or instructions can be pulled out from the computer, if questions are being asked by the customer. Of course, a sudden termination of the trace of a merchandise means the merchandise is diminishing in the store, which clearly indicates the burglar condition, thereby responded with the burglar alarm requesting for immediate attention.

An EM security system or managing system can not run by itself without recourse to the security tag system disclosed in this invention. Otherwise, the transmitter can be readily removed from the merchandise originally equipped with, rendering the EM security no longer existent. Only because of the security provided by the guard-tag system that prohibits the EM transmitter to be removed from the merchandise can the added EM security remain effective thereby providing additional security. Since all of the EM transmitters have distinctive IDs, management of merchandises or goods can be computerized.

The marriage between a security tag and an EM transmitter creates a smart tag system. For example, at the cashier desk there is no need to scan the price label for each of the merchandise selected by the customer, because before reaching the cashier desk, all of the merchandise have already been traced down by the computer whose ID's, and hence prices, are known. Automation in sale is thus possible. Once knows the total price, the customer pays it off by himself or by herself using a bank card. After the payment is cleared, the computer resets all of the guard tags to the mute state (for an indefinite length of time), allowing these tags to be removed from the merchandise, if intended. At this point the custom has two choices, either to keep the tags or to return them. If the customer choose to return the tags, he or she needs to remove the tags from the purchased merchandise and drop them in a box for a refund, in a manner similar to that a beer can is returned to and refunded by a machine (of course, the returned tags will not be crushed). If the merchandise are inexpensive, for example, as occurring in a supermarket, the tags can be affixed to rubber bands surrounding the merchandise so as to ease the removal process (local magnetic markers are firmly attached to or glued to the outer surfaces of the merchandise, either directly or indirectly, assuming their removal are rather difficult). Alternatively, the custom can choose to keep the tags without asking for a refund. Via mass production each tag may cost only $1 or less, and if the total purchase from the customer is over $100, the tag charge may be waived. Since the tags are very selective to each of the stores or the supermarkets, it is generally harmless to release the tags with the customer. In either way the security system agrees the customer has cleared up, allowing the paid merchandise to be removed from the store or the supermarket. Now, except for a few security guys, the store or the supermarket needs to hire nobody, thereby leading to a big save in personnel expenses.

Conclusions

A security/smart tag system is disclosed capable of providing full protection over a merchandise. The disclosed tag system will respond to an interrogation signal to clarify the unpaid condition of a merchandise, as does by a conventional tag. To differ from a conventional tag the disclosed tag system is able to monitor the environmental change local to the merchandise wrapped in a package. Thus, any bad intention trying to open or to impair the package of the merchandise will be caught, causing alarm to sound, not at the exit doorway, but on the spot. Unauthorized disarm of the tag system is almost impossible, because it requires a password. When equipped with an EM transmitter, wisdom is added to the tag system, allowing for computerized management together with reinforced security. The disclosed tag system is as compact as the conventional tag contained in the prior art. Most importantly, the disclosed tag system costs as little as the conventional tag, with its performance overwhelming.

I claim:

1. A method of obtaining security tag operation capable of monitoring against disturbance made to an object, comprising:

in the presence of the earth field installing one or more magnetic markers to jointly create a magnetic profile characteristic of the local environment of said object whose magnitude is measured by using one or more magnetic sensors installed at a position or positions at the enclosure or surrounding of said object, wherein by checking against said magnetic profile measured by said one or more magnetic sensors said disturbance can be identified, indicating security violations, which are induced by a condition of unauthorized relative movement of said one or more magnetic markers with respect to said one or more magnetic sensors resulting from breakage, distortion, or interruption of said object and/or its enclosure, and separately by a condition of alteration of a sensed magnetic field resulting from an external source or sources other than said one or more magnetic markers as a result of security failure, and alerting an alarm or warning in response to either of said conditions thereby realizing said security tag operation.

2. The method of claim 1 wherein said external source or sources include a transmitter of a transducer device generating an interrogation signal which disturbs said magnetic profile of said local environment of said object conditionally thereby initiating said security violation condition.

3. The method of claim 1 wherein said external source or sources include a piece or pieces of soft-magnetic sheet or block which screens said earth magnetic field disturbing said magnetic profile of said local environment of said object conditionally thereby initiating said security violation condition.

4. The method of claim 1 wherein depending on the nature of said security violation condition, said alarm signal in response takes various forms, being a constant buzzing sound, an intermittent buzzing sound, a weak bussing sound, or a loud bussing sound, indicating different levels in security warning.

5. The method of claim 1 wherein said security tag operation can only be reset or resumed not to activate said alarm signal only through authorized procedures in confidential which are not obtainable in a rash manner incorporating limited resources, including the use of a DC magnetic field of a large magnitude, or a magnetic field with predetermined waveform complied to the content of a password.

6. A security tag device capable of providing security protection over an object, comprising:

(A) one or more magnetic markers capable of creating a profile characteristic of the magnetic background defining the undisturbed or the unaltered condition of said object, (B) one or more magnetic sensor units installed at a predetermined position or positions at the enclosure or surrounding of said object, measuring in situ the magnitude of said profile of said magnetic background, (C) one or more buzzer units capable of releasing alarms at predetermined warning levels, (D) a microprocessor unit taking control over processes required by the operation of said security tag device, (E) one or more power units, supplying power to said one or more magnetic sensor units, said one or more buzzer units, and said microprocessor unit, wherein, via the use of said one or more magnetic sensor units said profile of said magnetic background created by said one or more magnetic markers together with the earth field is constantly monitored, to identify disturbances occurring to said magnetic background resulting from a condition of breakage, distortion, or interruption of said object and/or its enclosure, and separately from a condition of alteration of a sensed magnetic field resulting from an external source or sources other than said one or more magnetic markers, said microprocessor unit activates said one or more buzzer units accordingly in response to either of these conditions, signaling the condition of security violation thereby providing security protection over said object.

7. The security tag device of claim 6 wherein said disturbances to said profile of said magnetic background results from offensive situations that said object is relatively moved without authorization with respect to said object's enclosure or surrounding allocated with said one or more magnetic sensor units.

8. The security tag device of claim 6 wherein said disturbance to said profile of said magnetic background results from an interrogation signal or is induced by a conditional screening effect to said earth field.

9. The security tag device of claim 6 wherein an external microphone unit is employed listening to said one or more buzzer units thereby amplifying the received sound level via loud speakers so as to attract more attention.

10. The security tag device of claim 6 wherein said one or more magnetic sensor units includes inductor probes, Hall probes, magnetoresistive probes, or fluxgate probes.

11. The security tag device of claim 6 wherein said one or more magnetic sensor units measures said profile of said magnetic background in 1D, 2D, or 3D.

12. The security tag device of claim 6 wherein said one or more power units includes a battery, a photocell, or a combination.

13. The security tag device of claim 6 wherein said microprocessor unit is able to manage and report the status of a battery contained with said one or more power units.

14. The security tag device of claim 6 wherein said microprocessor unit is able to manage and report the status of a mechanical case enclosing the assembly of said microprocessor unit, said one or more buzzer units, and/or said one or more power units.

15. The security tag device of claim 6 wherein a photodectector is used to detect a conditional dark condition if said object is concealed in a briefcase or in a container for unclear or unauthorized reasons.

16. The security tag device of claim 6 wherein a transmitter unit or units is added which is able to generate an identification signal or signals characteristic of said object thereby admitting smart-tag operation functions to take place.

17. The security tag device of claim 16 wherein said identification signal or signals include EM signals with identifiable codes or waveforms.

18. The security tag device of claim 16 wherein said smart-tag operation functions allow for automation in sale.

19. The security tag device of claim 6, wherein a local shielding plane or planes is installed near said one or more magnetic sensor units so that external magnetic flux generated from an external source or sources other than said one or more magnetic markers are partially screened resulting in local shielding of said one or more magnetic sensor units thereby reducing false alarm rates.

20. The security tag device of claim 6, wherein a mean of local condensing of magnetic flux is provided and deployed with one or more of said one or more magnetic sensor units condensing magnetic flux generated from said one or more magnetic markers and said earth field making uniform and hence stabilizing the local fields nearby so as to facilitate the operation of said security tag device.

21. A method of obtaining security tag operation capable of monitoring against disturbance made to an object, comprising:

in the presence of the earth field installing one or more magnetic markers to jointly create a magnetic profile characteristic of the local environment of said object whose magnitude is measured by using one or more magnetic sensors installed at a position or positions at the enclosure or surrounding of said object;

wherein by checking against said magnetic profile measured by said one or more magnetic sensors said disturbance can be identified, indicating security violations, which are induced by a condition of unauthorized relative movement of said one or more magnetic markers with respect to said one or more magnetic sensors resulting from breakage, distortion, rotation, or interruption of said object and/or its enclosure, and alerting an alarm or warning in response to said condition thereby realizing said security tag operation.

* * * * *